US009047741B2

(12) United States Patent
Suda

(10) Patent No.: US 9,047,741 B2
(45) Date of Patent: Jun. 2, 2015

(54) GAMING MACHINE AND METHODS OF ALLOWING A PLAYER TO PLAY A GAMING MACHINE HAVING MULTIPLE GAMES WITH THE SAME REEL

(71) Applicant: Konami Gaming, Inc., Las Vegas, NV (US)

(72) Inventor: Satoshi Suda, Henderson, NV (US)

(73) Assignee: KONAMI GAMING, INC., Las Vegas, NV (US)

( * ) Notice: Subject to any disclaimer, the term of this patent is extended or adjusted under 35 U.S.C. 154(b) by 0 days.

(21) Appl. No.: 14/316,131

(22) Filed: Jun. 26, 2014

(65) Prior Publication Data

US 2015/0031436 A1 Jan. 29, 2015

(51) Int. Cl.
*G07F 17/34* (2006.01)
*G07F 17/32* (2006.01)

(52) U.S. Cl.
CPC ..... *G07F 17/34* (2013.01); *G07F 17/3213* (2013.01); *G07F 17/32* (2013.01)

(58) Field of Classification Search
CPC ..... G07F 17/32; G07F 17/3213
See application file for complete search history.

(56) References Cited

U.S. PATENT DOCUMENTS

2002/0183105 A1 12/2002 Cannon et al.
2004/0043815 A1 3/2004 Kaminkow
2009/0203420 A1 8/2009 Yoshizawa
2012/0122564 A1 5/2012 Kovacs et al.

FOREIGN PATENT DOCUMENTS

EP 1 463 009 A2 9/2004

OTHER PUBLICATIONS

Patent Examination Report No. 1 (AU 2013209366)—Date of Issue: Nov. 20, 2013.

*Primary Examiner* — Lawrence Galka
(74) *Attorney, Agent, or Firm* — Howard & Howard Attorneys PLLC

(57) ABSTRACT

A gaming machine for providing multiple games to a player with the same reel is described herein. The gaming machine displays a first game that includes a first portion of a reel in a first display area and concurrently displays a second game that includes a second portion of the reel being displayed in a second display area. The gaming machine randomly generates an outcome of the first game and spins and stops the at least one reel to display the first game outcome in the first display area and awards the player an award as a function of the first game outcome.

20 Claims, 8 Drawing Sheets

GAMING MACHINE AND METHODS OF ALLOWING A PLAYER TO PLAY A GAMING MACHINE HAVING MULTIPLE GAMES WITH THE SAME REEL

CROSS REFERENCE TO RELATED APPLICATION

This application claims priority to Australian Patent Application No. 2013209366, filed Jul. 26, 2013, the disclosure of which is hereby incorporated by reference in its entirety.

TECHNICAL FIELD

The subject matter disclosed herein relates generally to gaming machines and more particularly, to an apparatus and method for allowing players to play a game having multiple games with the same reels.

BACKGROUND OF THE INVENTION

Known gaming machines include a video display device to display a reel game that includes a plurality of reels with each reel including a plurality of symbols. During game play, the gaming machine accepts a wager from a player, the player selects one or more paylines, the gaming machine spins the reels, and sequentially stops each reel to display a combination of symbols on the reels. The gaming machine then awards the player an award based on the combination of symbols orientated along the selected payline.

At least some known gaming machines allow the player to play one instance of a game at a time and may display a first game including a plurality of symbols, copy a special symbol appearing in the outcome of the first game, and display the special symbol in the outcome of the second game. Over time, during game play, the player may become frustrated because of the limited number of games that may be played at any one time. Accordingly, new features are necessary to appeal to player interest and enhance excitement in order to entice longer play and increased profitability. The present invention is directed to satisfying these needs.

SUMMARY OF THE INVENTION

In one aspect of the present invention, a method of allowing a player to play a slot game with a gaming machine is provided. The slot game includes a plurality of reels each having a plurality of game symbols arranged. The method includes displaying, on a display device, a first game including a first portion of at least one reel of the plurality of reels being displayed in a first display area, and displaying a second game including a second portion of the reel being displayed in a second display area. The second game is displayed concurrently with the first game. The method includes randomly generating an outcome of the first game and spinning and stopping the reel to display the first game outcome in the first display area and awarding the player an award as a function of the first game outcome.

In another aspect of the present invention, a gaming machine is provided. The gaming machine includes a display device for displaying a slot game. The slot game includes a plurality of reels having a plurality of game symbols. The gaming machine also includes a user input device that is configured to generate a signal indicative of a player's selection input and a controller that is coupled to the display device and the user input device. The controller displays a first game that includes a first portion of at least one reel of the plurality of reels being displayed in a first display area. The controller also displays a second game that includes a portion of the reel being displayed in a second display area, wherein the second game is displayed concurrently with the first game. The controller randomly generates an outcome of the first game and spins and stops the at least one reel to display the first game outcome in the first display area and awards the player an award as a function of the first game outcome.

In yet another aspect of the present invention, a system is provided. The system includes a plurality of gaming devices and a system controller coupled to each gaming device. Each gaming device includes a user input device for accepting a player's selection input and a display device. The system controller displays a slot game on at least one gaming device including a plurality of reels that each having a plurality of game symbols. The system controller also displays a first game that includes a first portion of at least one reel of the plurality of reels displayed in a first display area, and displays a second game that includes a second portion of the reel being displayed in a second display area. The second game is displayed concurrently with the first game. The system controller also randomly generates an outcome of the first game, spins and stops the at least one reel to display the first game outcome in the first display area, and awards the player an award as a function of the first game outcome.

In another aspect of the present invention, one or more non-transitory computer-readable storage media, having computer-executable instructions embodied thereon, is provided. The computer-executable instructions, when executed by at least one processor, cause the processor to display a first game on a display device, wherein the first game includes a plurality of reels with each reel having a plurality of game symbols, and wherein the first game includes a first portion of at least one reel of the plurality of reels being displayed in a first display area. The computer-executable instructions, when executed by at least one processor, cause the processor to display a second game including a second portion of the reel being displayed in a second display area, randomly generate an outcome of the first game and spin and stop the at least one reel to display the first game outcome in the first display area, and award the player an award as a function of the first game outcome.

BRIEF DESCRIPTION OF THE DRAWINGS

Other advantages of the present invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

With reference to the drawings and in operation, the present invention overcomes at least some of the disadvantages of known gaming machines by providing a gaming machine that simultaneously displays a plurality of slot games using the same reel. More specifically, the gaming machine allows a player to play multiple games with the same reel by displaying a portion of the same reel in each slot game.

In general, the gaming machine concurrently displays a first game including a first portion of a reel being displayed in a first display area and a second game that includes a second portion of the reel being displayed in a second display area. The first and second games are orientated with respect to each other such that a symbol appearing in one display area is moved to the other display area as the reel is spun. The gaming machine also allows a player to select a payline associated with the first game, and replicates the player selected payline in the second game. By providing a gaming machine that concurrently displays a plurality of slot games with the same reel, the player's expectation for achieving a win is increased and the enjoyment of the game is improved. Moreover, the player can anticipate a potential combination of symbols appearing in the first game as the symbols are moved from the second game display area towards the first game display area. Thus, the amount of time that the game is played by patrons of a gaming establishment is thereby increased.

A selected embodiment of the present invention will now be explained with reference to the drawings. It will be apparent to those skilled in the art from this disclosure that the following description of the embodiment of the present invention is provided for illustration only and not for the purpose of limiting the invention as defined by the appended claims and their equivalents.

Figure 1:
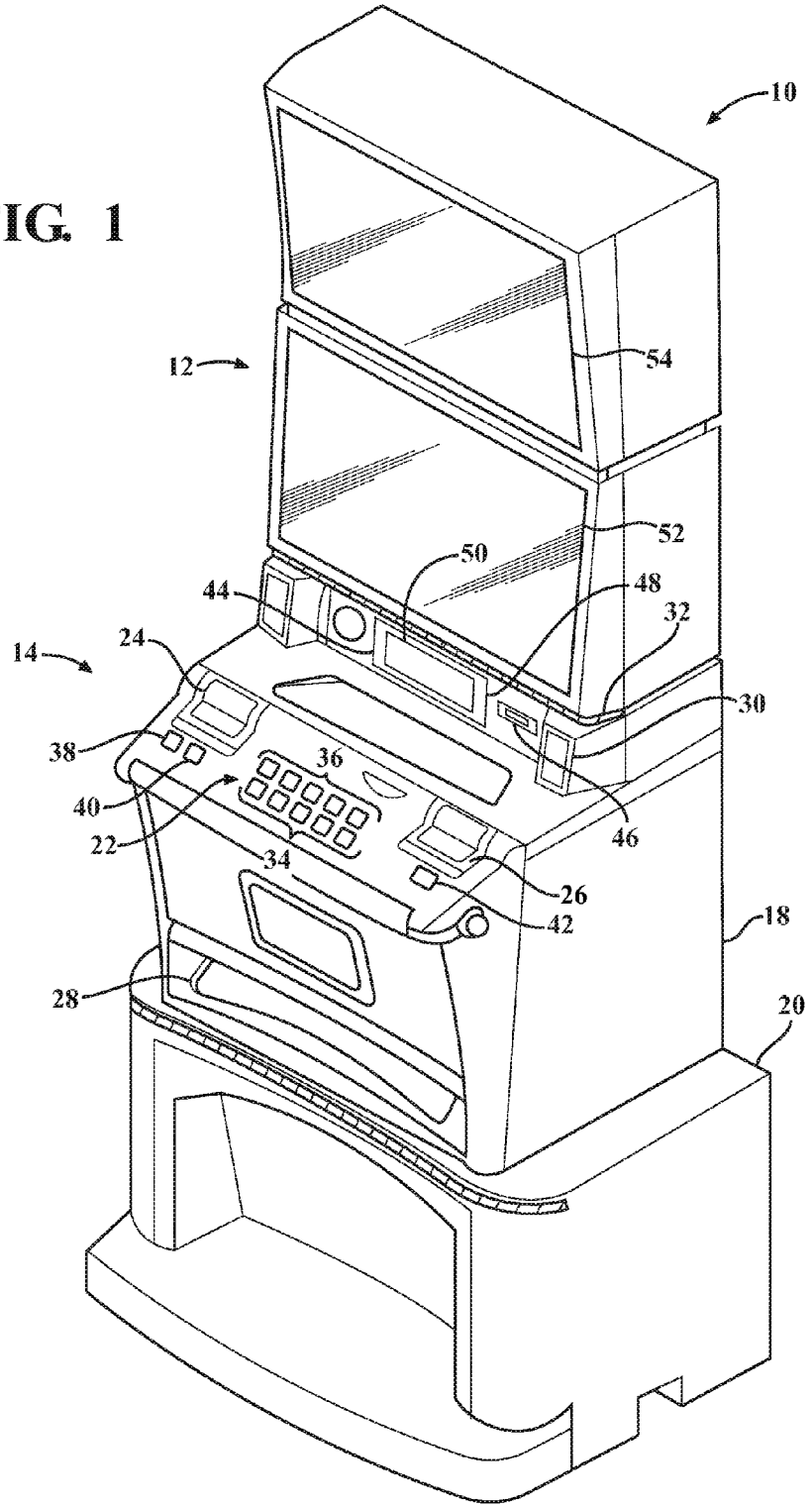
FIG. 1 is a perspective view of an exemplary gaming machine of the present invention.
Figure 2:
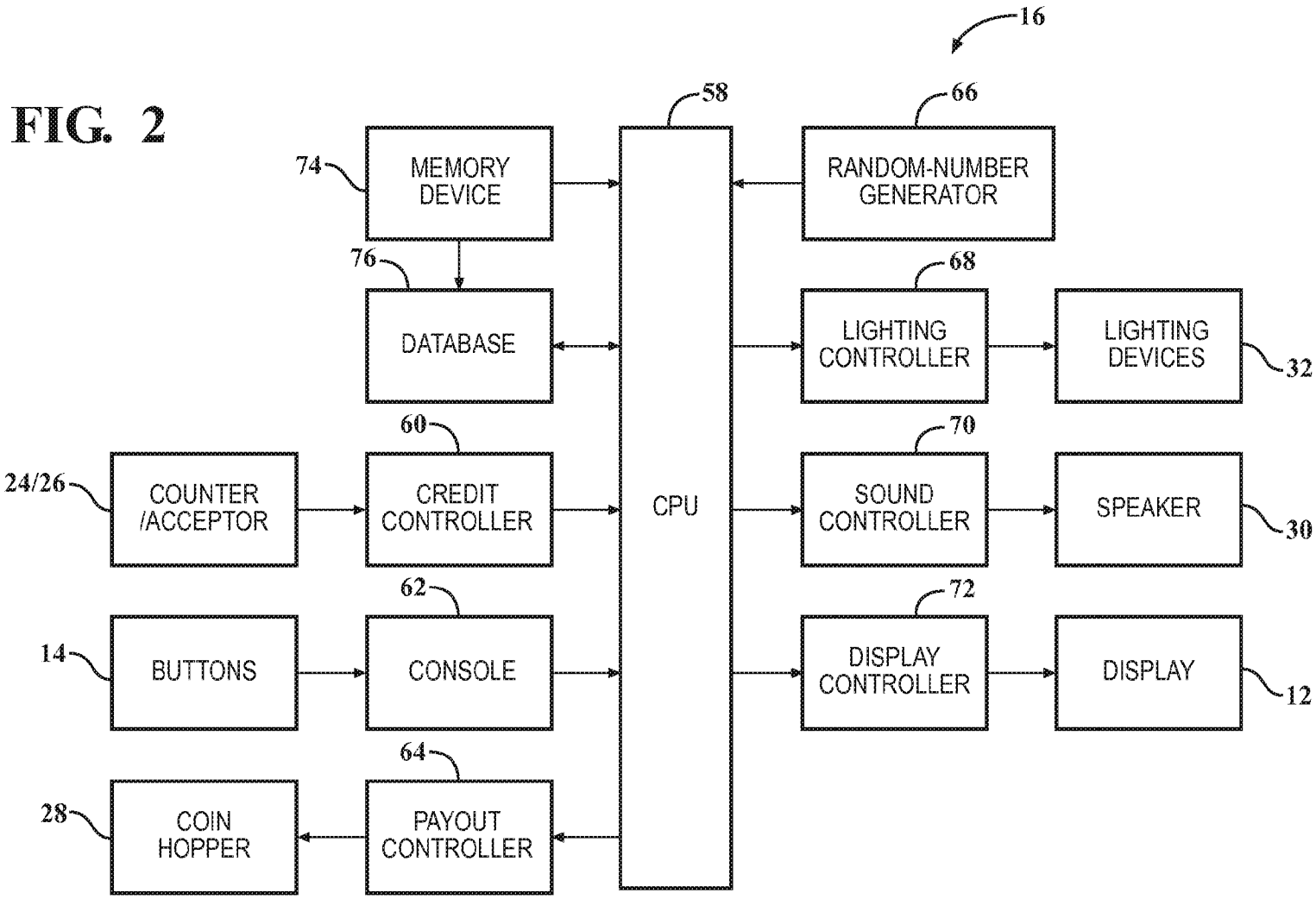
FIG. 2 is a schematic representation of the gaming machine shown in FIG. 1.

FIG. 1 is a perspective view of an exemplary gaming machine 10. FIG. 2 is a schematic representation of the gaming machine 10. A preferred embodiment of the present invention is a video gaming machine preferably installed in a casino. In the illustrated embodiment, the gaming machine 10 includes a display device 12 for displaying a plurality of games, a user input device 14 to enable a player to interface with the gaming machine 10, and a gaming controller 16 that is operatively coupled to the display device 12 and the user input device 14 to enable a player to play games displayed on the display device 12. The gaming machine 10 also includes a cabinet assembly 18 that is configured to support the display device 12, the user input device 14, and/or the gaming controller 16 from a gaming stand 20 and/or a supporting surface.

The display device 12 and the user input device 14 are each coupled to the cabinet assembly 18 and are each accessible by the player. In one embodiment, the gaming controller 16 is positioned within the cabinet assembly 18. Alternatively, the gaming controller 16 may be separated from the cabinet assembly 18, and connected to components of the gaming machine 10 through a network such as, for example, a local area network (LAN), a wide area network (WAN), dial-in-connections, cable modems, wireless modems, and/or special high-speed Integrated Services Digital Network (ISDN) lines.

In one embodiment, the user input device 14 includes a plurality of input buttons 22, a coin slot 24, and/or a bill acceptor 26. The coin slot 24 includes an opening that is configured to receive coins and/or tokens deposited by the player into the gaming machine 10. The gaming machine 10 converts a value of the coins and/or tokens to a corresponding amount of gaming credits that are used by the player to wager on games played on the gaming machine 10.

The bill acceptor 26 includes an input and output device that is configured to accept a bill, a ticket, and/or a cash card into the bill acceptor 26 to enable an amount of gaming credits associated with a monetary value of the bills, ticket, and/or cash card to be credited to the gaming machine 10. Moreover, the gaming machine 10 may also utilize a cashless wagering system (not shown), such as a ticket in ticket out (TITO) system (not shown). In one embodiment, the bill acceptor 26 also includes a printer (not shown) that is configured to dispense a printed voucher ticket that includes information indicative of an amount of credits and/or money paid out to the player by the gaming machine 10 during a gaming session. The voucher ticket may be used at other gaming machines, or redeemed for cash, and/or other items as part of a casino cashless system (not shown).

A coin tray 28 is coupled to the cabinet assembly 18 and is configured to receive a plurality of coins that are dispensed from the gaming machine 10. One or more speakers 30 are installed inside the cabinet assembly 18 to generate voice announcements and/or sound effects associated with game play. The gaming machine 10 also includes one or more lighting devices 32 that are configured to blink and/or change brightness and color in specific patterns to produce lighting effects to enhance a visual gaming experience for the player.

In one embodiment, the input buttons 22 include a plurality of BET switches 34 for inputting a wager on a game, a plurality of selection switches 36 for selecting a betting line, a payline, and/or card, a MAXBET switch 38 for inputting a maximum wager, a PAYOUT switch 40 for ending a gaming session and dispensing accumulated gaming credits to the player, and a start switch, i.e., a SPIN/DEAL button 42 to initiate an output of a game.

In the illustrated embodiment, the BET switches 34 include five switches from 1BET to 5BET to enable a player to wager between a minimum bet up to 5× minimum bet. Each selection switch 36 corresponds to a betting line such as, for example, a payline and/or symbol for a reel game, one or more cards for a card game, and/or a symbol for a roulette game, to enable a player to associate a wager with one or more betting lines. The MAXBET switch 38 enables a player to input the maximum bet that a player can spend against one play of a game. The PAYOUT switch 40 enables a player to receive the amount of money and/or credits awarded to the player during a gaming session, which has been credited onto the gaming machine 10.

The gaming machine 10 also includes a player tracking device 44 that is coupled to the gaming controller 16 for identifying the player and/or a player tracking account that is associated with the player. The player tracking account may include, but is not limited to, gaming credits available to the player for use in playing the gaming machine 10. The player tracking device 44 is configured to communicate player account information between a player tracking controller (not shown) and the gaming machine 10. For example, the player tracking device 44 may be used to track bonus points and/or credits awarded to the player during a gaming session and/or track bonus and/or credits downloaded to the gaming machine 10 from the player tracking system. In the illustrated embodiment, the player tracking controller assigns a player status, e.g. a player ranking, based on the player account information. For example, the player tracking information may include, but is not limited to, a frequency in which the player plays a game, the average wager the player makes per play of a game, a total amount wagered by the player over a predefined period of time, and/or any other suitable player tracking information.

The player tracking device 44 is coupled to the gaming cabinet assembly 18 and includes a player identification card reader 46, a data display 48, and a keypad 50. The player identification card reader 46 is configured to accept a player tracking card (not shown) inserted by the player, and read information contained on the player tracking card to identify the player account information. The player identification card reader 46 may include, but is not limited to, a barcode reader, a magnetic card reader, and/or a radio frequency identification (RFID) card reader. The keypad 50 is configured to accept a user selection input such as, for example, a unique player personal identification number (PIN) to facilitate enabling the gaming machine 10 to identify the player, and access player account information associated with the identified player to be displayed on the data display 48. In one embodiment, the data display 48 includes a touchscreen panel that includes the keypad 50. Alternatively, the data display 48 and the keypad 50 may be included in the display device 12.

In one embodiment, the display device 12 includes a first display 52 and a second display 54. The first display 52 is configured to display a game screen 56 (shown in FIGS. 3-5) including indicia and/or symbols for use in a game, e.g., cards used by a card game, roulette wheel and symbols used in a roulette game, and reels used in a reel game. The game screen 56 may include any type of game including, but not limited to, a video slot game, a keno game, a blackjack game, a video poker game, or any type of game which allows a player to make a wager, play a game, and potentially provide the player an award based on an outcome of the game and a paytable. The second display 54 is configured to display game play instructions for performing the game including, but not limited to, playing instructions, paytables, paylines, betting lines and/or any other information to enable the gaming machine 10 to function as described herein. Moreover, each display 52 and 54 may be configured to display at least a portion of the game screen 56 and/or game play instructions. In one embodiment, the first and second displays 52 and 54 each include a flat panel display, such as a cathode ray tube display (CRT), a liquid crystal display (LCD), a light-emitting diode display (LED), an organic light-emitting diode display (OLED), an active-matrix organic light-emitting diode display (AMOLED), a plasma display, and/or any suitable visual output device capable of displaying graphical data and/or text to a user. Alternatively, a single component, such as a touch screen, may function as both the display device 12 and as the user input device 14. In an alternative embodiment, the first display 52 and/or the second display 54 includes a plurality of mechanical reels displaying a plurality of game symbols.

Referring to FIG. 2, in one embodiment, the gaming controller 16 includes a processor, i.e., a central processing unit (CPU) 58, a credit controller 60, a console unit 62, a payout controller 64, a random-number generator (RNG) 66, a lighting controller 68, a sound controller 70, a display controller 72, a memory device 74, and a database 76. Memory device 74 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the CPU 58 to store, retrieve, and/or execute instructions and/or data.

The CPU 58 executes various programs, and thereby controls other components of the gaming controller 16 according to player instructions and data accepted by the user input device 14. The CPU 58 in particular executes a game program, and thereby conducts a game in accordance with the embodiments described herein. The memory device 74 stores programs and databases used by the CPU 58. Moreover, the memory device 74 stores and retrieves information in the database 76 including, but not limited to, wagers, wager amounts, average wagers per game, a game type, a number of reels associated with a game, a number of reel strips associated with each reel, a number of symbols being displayed on each reel strip, a type of symbol being displayed on reel strip, a predefined set of normal symbols, a predefined set of special symbols, a number of games being displayed within the game screen 56, a number of symbol cells being displayed with each game, image data for producing game images and/or screens on the display device 12, and temporarily stores variables, parameters, and the like that are used by the CPU 58. In addition, the memory device 74 stores indicia, symbol weights, symbol values, paytables, and/or winning combination tables which represent relationships between combinations of random numbers and types of awards. In one embodiment, the memory device 74 utilizes RAM to temporarily store programs and data necessary for the progress of the game, and EPROM to store, in advance, programs and data for controlling basic operation of the gaming machine 10, such as the booting operation thereof.

The credit controller 60 manages the amount of player's credits, which is equivalent to the amount of coins and bills counted and validated by the bill acceptor 26. The console unit 62 is coupled to the user input device 14 to monitor player selections received through the input buttons 22, and accept various instructions and data that a player enters through the input buttons 22. The payout controller 64 converts a player's credits to coins, bills, or other monetary data by using the coin tray 28 and/or for use in dispensing a credit voucher via the bill acceptor 26.

The lighting controller 68 controls one or more lighting devices 32 to blink and/or change brightness and color in specific patterns in order to produce lighting effects associated with game play. The sound controller 70 controls the speakers 30 to output voice announcements and sound effects during game play. The display controller 72 controls the display device 12 to display various images on screens preferably by using computer graphics and image data stored in the memory device 74. More specifically, the display controller 72 controls video reels in a game screen displayed on the first display 52 and/or the second display 54 by using computer graphics and the image data.

The RNG 66 generates and outputs random numbers to the CPU 58 preferably at the start of each round of a game. The CPU 58 uses the random numbers to determine an outcome of the games. For example, if the game is a video slot game, the CPU 58 uses the RNG 66 to randomly select an arrangement of symbols to be displayed on video reels. Moreover, the CPU 58 generally uses random numbers generated by the RNG 66 to play the games and to determine whether or not to provide an award to a player. In one embodiment, the CPU 58 may also use the random numbers to determine a stop position of each reel associated with a first game and use the stop position to determine the outcome of the first game and a concurrently displayed second game using the same reel. In addition, the CPU 58 generates game outcomes including combinations of random numbers, and compares the generated combinations with winning combinations stored in the winning combination table to determine if the generated outcome is a winning outcome that is associated with a type of award.

Figure 3:
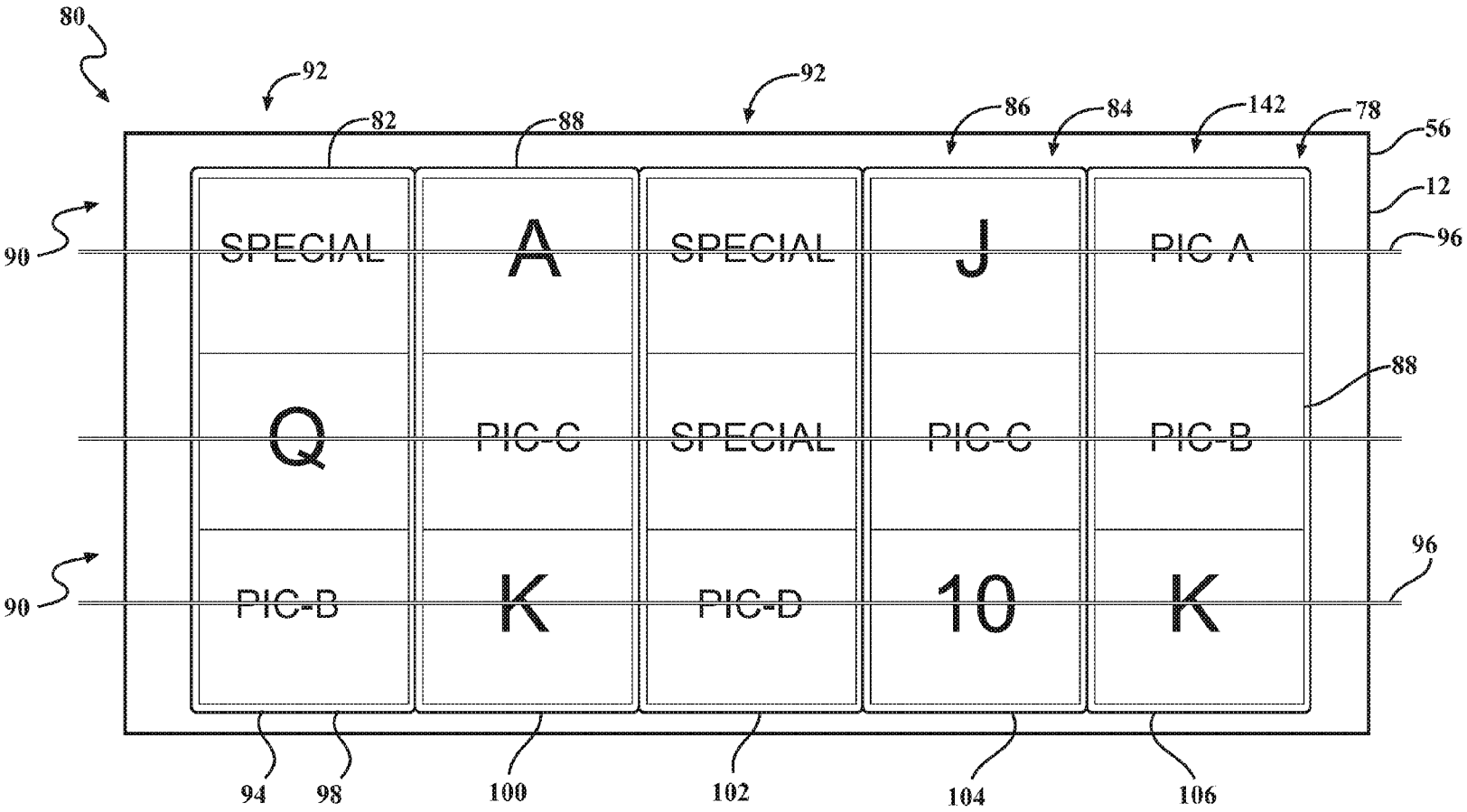
FIG. 3 is a graphical display of a video slot game, according to an embodiment of the present invention.
Figure 4:
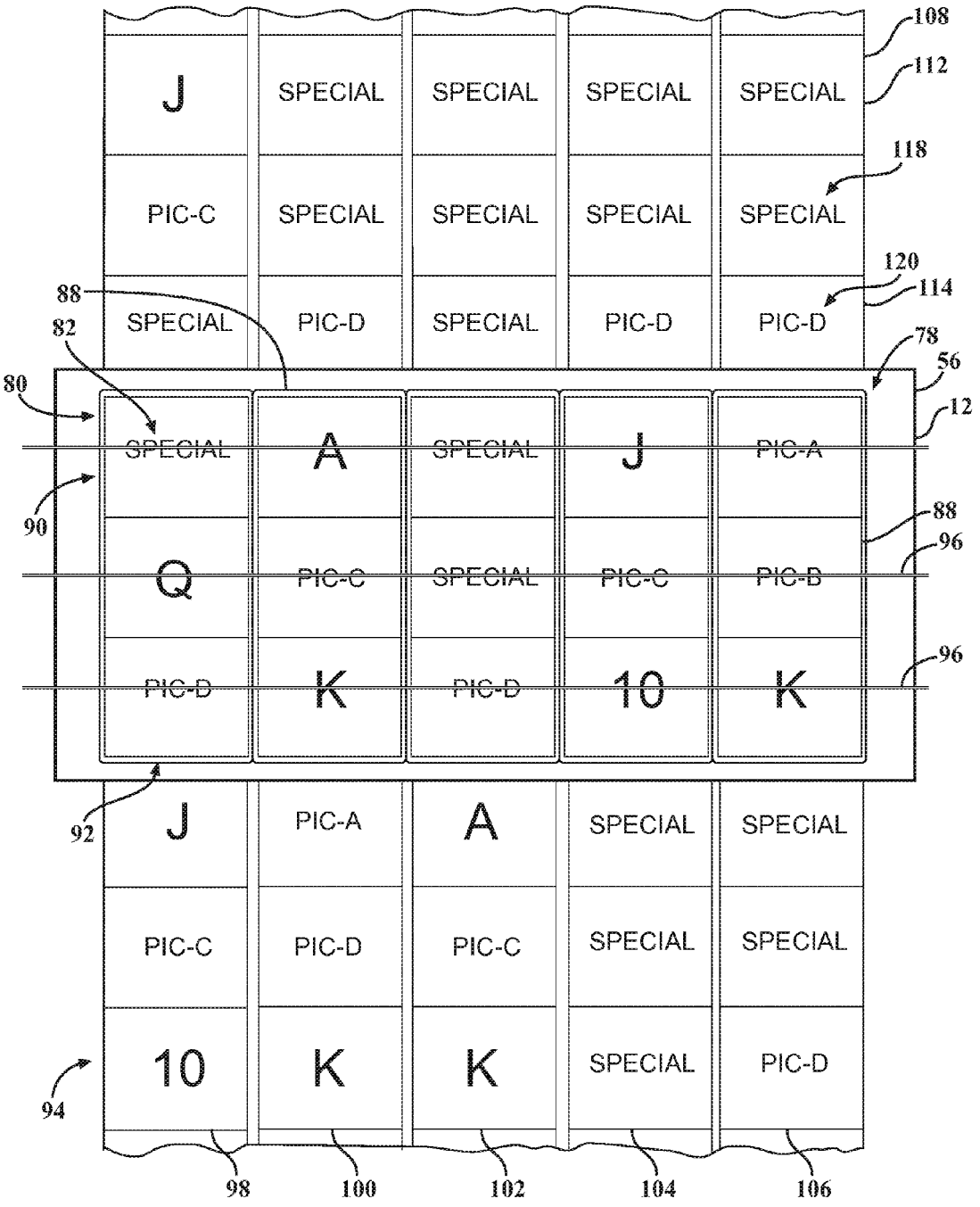
FIG. 4 is a schematic representation of a portion of the gaming machine shown in FIG. 1 including the video slot game of FIG. 3 illustrating a plurality of slot reels, according to an embodiment of the present invention.

FIG. 3 is an exemplary graphical display of a game 78 that is displayed by the gaming machine 10. FIG. 4 is a schematic representation of a portion of the gaming machine 10 including the game 78. In the illustrated embodiment, the gaming controller 16 is configured to display the game 78 on the display device 12. In one embodiment, the game 78 is a video slot game. However, it should be noted that the game 78 may be any type of game upon which a player could make a wager including, but not limited to a keno game, a blackjack game, a video poker game, or any type of game that enables the gaming controller 16 to function as described herein. In the illustrated embodiment, the game 78 is displayed on the first display 52. Alternatively, the game 78 may be displayed on the first display 52 and/or the second display 54.

In general, during play of the game 78, the gaming controller 16 randomly generates an outcome of the game 78 and displays the generated game outcome 80 in the game screen 56. The gaming controller 16 randomly selects a plurality of game symbols 82 from a predefined set of possible game symbols and displays the selected game symbols 82 associated with the generated game outcome 80 in the game screen 56.

In the illustrated embodiment, the plurality of symbols 82 are displayed in display area 84 that includes a grid 86 having a plurality of cells 88 arranged along a plurality of rows 90 and a plurality of columns 92. Each cell 88 displays one or more game symbols 82 associated with the game outcome 80. In the illustrated embodiment, the gaming controller 16 displays the game symbols 82 within a plurality of reels 94. Each reel 94 is associated with a corresponding column 92. The game 78, in the illustrated embodiment, includes 5 reels 94 with 3 cells per reel, respectively (a "5×3" arrangement) displayed in the display area 84. Alternatively, other reel arrangements may be used such as, for example, 3-4-3-4-3, 4-5-5-5-4, or 4-5-4-5-4 arrangements or arrangements with the same number of cells per column, such as 3×3, 3×4, 4×5, or 5×5 configurations. The game 78 also includes a plurality of paylines 96 that extend across one or more cells 88 to indicate, to the player, a combination of game symbols 82. In one embodiment, the gaming machine 10 may display the game 78 via a plurality of mechanical reels (not shown) that include a plurality of symbols displayed on a circumferential surface of each reel.

Each slot game 78 is generally played in a conventional manner. The player makes a wager, which may be based on a predetermined denomination and a selected number of paylines 96, the gaming controller 16 randomly generates an outcome for the game 78, spins the reels 94, and selectively stops the reels 94 to display a game symbol 82 in each of the display cells 88. If a predetermined pattern of symbols 82 is randomly chosen for each cell 88 on a played payline 96, the player may be awarded a payout based on the payline, the wager, and a predetermined paytable. Moreover, the player may be awarded a payout if the combination of symbols 82 associated with a selected payline 96 is a winning combination. In addition, a player may receive a bonus feature and/or a bonus game based on the combination of symbols 82 associated with the selected payline 96 and/or the appearance of one or more predefined symbols 82 in the game outcome 80. Many variations to the above described general play of a slot game fall within the scope of the present invention. Such slot games are well-known in the art, and are therefore not further discussed.

In the illustrated embodiment, the gaming controller 16 receives a signal, from the user input device 14, that is indicative of a player's selection to initiate a gaming session including a wager amount, and a selection of one or more paylines 96 associated with a predefined set of cells 88 within the display area 84. In the illustrated embodiment, the game 78 is a multi-line game, i.e., the paylines include horizontal paylines and/or diagonal pay-lines, and/or zig-zag paylines. Moreover, the user input device 14 may allow the player to toggle to increase the bet per payline a credit at a time (up to the maximum bet). The gaming controller 16 randomly generates an outcome of the game 78, and displays the generated outcome 80 on the game screen 56. In one embodiment, the gaming controller 16 is configured to rotate, and/or spin each reel 94 to initiate a game play, and stop each reel 94 to display a plurality of symbols 82 associated with the randomly generated outcome 80. In addition, the gaming controller 16 is adapted to determine if the generated outcome 80 is a winning outcome as a function of the displayed game symbols 82, a pay-table, a wager, and one or more player selected paylines 96. More specifically, the gaming controller 16 determines if a combination of symbols 82 arranged along the selected payline 96 is a winning combination. The gaming controller 16 may provide an award in response to the outcome of the game 78. In general, the term "award" may be a payout, in terms of credits or money. Thus, the gaming controller 16 may award a regular payout in response to the outcome of the game 78. However, it should be noted that the term award may also refer to other types of awards, including, prizes, e.g., meals, show tickets, etc. . . . , as well as in-game award, such as free games or awarding the player one or more wild symbols or stacked wild symbols in each of the games.

The gaming controller 16 is configured to display the game 78 including a plurality of reels 94. For example, in one embodiment, the gaming controller 16 displays the game 78 having five reels 94 orientated horizontally and including a $1^{st}$ reel 98, a $2^{nd}$ reel 100, a $3^{rd}$ reel 102, a $4^{th}$ reel 104, and a $5^{th}$ reel 106. Each reel 94 includes one or more associated reel strips 108 (shown in FIGS. 6-8) that may be displayed on a respective reel 94. Each reel strip 108 includes a plurality of symbol positions 110 that each have a game symbol 82 displayed therein. During display of the generated game outcome 80, the gaming controller 16 spins each reel 94 such that the game symbols 82 are moved through each of the cells 88 in the display area 84.

In one embodiment, each reel 94 may include a reel strip 108 having a plurality of symbol positions 110 including a plurality of special symbol positions 112 (represented by the "special" mark shown in FIGS. 3-8) and a plurality of normal symbol positions 114. Moreover, the reel strip 108 includes at least one run 116 of consecutive special symbol positions 112 (shown in FIGS. 6-8) that include a plurality of adjacent special symbol positions 112. During a round of the game 78, the gaming controller 16 randomly selects at least one special symbol 118 from a predefined set of special symbols 118, and displays the selected special symbol 118 in each special symbol position 112 of the run 116 of consecutive special symbol positions 112. In the illustrated embodiment, the gaming controller 16 displays the same special symbol 118 in each special symbol position 112 of the run 116 of consecutive special symbol position 112. Alternatively, the gaming controller 16 may select a plurality of similar special symbols 118 and/or a plurality of associated special symbols such as, for example, a set of special symbols included in a category of special symbols, for display in each special symbol position 112. For example, the predefined set of special symbols 118 may include, but is not limited to, a category of special symbols such as, for example, shapes, colors, sounds, items, characters, backgrounds, frames, and/or any category of special symbols that enable the gaming controller 16 to function as described herein. Each special symbol category includes a plurality of special symbols having predefined characteristics associated with the special symbol category. For example, the predefined set of special symbols 118 may include a shape category that includes a plurality of special symbols that each have a shape associated with the shape category. The gaming controller 16 may select one or more special symbols indicative of the shapes within the shape category, and display the selected special symbols in each of the special symbol positions 112.

In the illustrated embodiment, each reel strip 108 also includes a plurality of normal symbols 120 (represented by the "PIC-a", "PIC-b", "PIC-c", "PIC-d", "A", "K", "Q", "J", and "10" symbol marks shown in FIGS. 3-8) that are displayed in each normal symbol position 114. In the illustrated embodiment, the normal symbols 120 are static symbols wherein each normal symbol 120 appears in the associated normal symbol position 114 for each round of the game 78. Alternatively, the gaming controller 16 may randomly select a plurality of normal symbols 120 from a predefined set of normal symbols 120 for each game 78 such that each game 78 may include a different set of normal symbols 120 being displayed in each of the normal symbol positions 114. In addition, the predefined set of normal symbols 120 may include any game symbol not included in the predefined set of special symbols 118.

Figure 5:
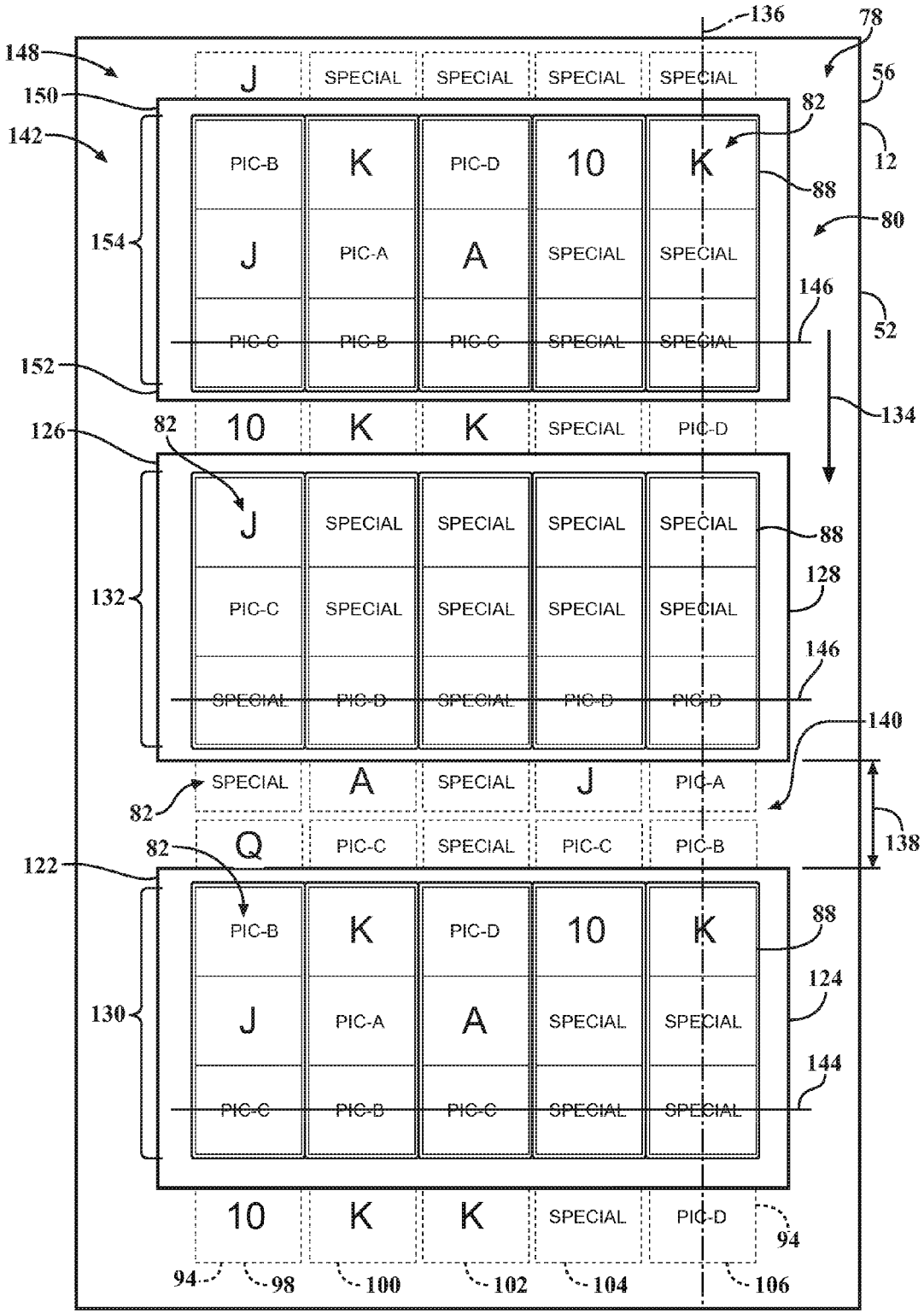
FIG. 5 is a second graphical display of the slot game of FIG. 3 including a plurality of games using the same reel, according to an embodiment of the present invention.

FIG. 5 is a graphical display of the slot game 78 including a plurality of game outcomes 80 being displayed using the same reels 94. In the illustrated embodiment, the gaming controller 16 displays the game 78 including a first game 122 being displayed in a first display area 124 and a second game 126 being displayed in a second display area 128 that is different than the first display area 124. In the illustrated embodiment, the first game 122 and the second game 126 are each displayed in the same game screen 56 and on the same display 52. The gaming controller 16 displays the first game 122 and the second game 126 with at least one reel 94 that extends from the first game 122 to the second game 126 such that a portion of the reel 94 is displayed in the first display area 124 and the second display area 128 simultaneously. For example, in the illustrated embodiment, the gaming controller 16 displays the first game 122 with a first portion 130 of the reel 94 being displayed in the first display area 124, and displays the second game 126 with a second portion 132 of the reel 94 being displayed in the second display area 128. The gaming controller 16 displays the first game 122 concurrently with the second game 126 such that the first and second portions 130 and 132 of the reel 94 are visible to the player simultaneously. In another embodiment, the first game 122 may be displayed in the first display 52 and the second game 126 may be displayed on the second display 54 with the reel 94 extending from the first display 52 to the second display 54.

In the illustrated embodiment, the gaming controller 16 randomly generates an outcome of the first game 122 and spins and stops the reel 94 to display the first game outcome 122. The gaming controller 16 also spins the reel 94 such that a symbol 82 being displayed on the reel strip 108 that is associated with the reel 94 is moved from the first display area 124 to the second display area 128 as the reel is spun. For example, in one embodiment, the second display area 128 is orientated with respect to the first display area 124 such that as the reel 94 is rotated in a direction 134, a symbol 82 being displayed in the reel 94 is moved from the second display area 128 towards the first display area 124. In the illustrated embodiment, the reel 94 is orientated with respect to a column 92 being displayed within the first display area 124 and extends through a corresponding column 92 in the second display area 128 along a longitudinal axis 136. In addition, the second display area 128 is spaced a distance 138 from the first display area 124 along the longitudinal axis 136 such that during a rotation of the reel 94, the symbols 82 appearing in the second display area 128 are moved from the second display area 128 and through the first display area 124 as the reel 94 is rotated during game play. For example, as the reel 94 is rotated, a symbol 82 appearing the $1^{st}$ column 92 associated with the second display area 128 is moved through the second display area 128 and through the $1^{st}$ column 92 of the first display area 124. Alternatively, the gaming controller 16 may rotate the reel 94 such that the symbols 82 are rotated through the first display area 124 and towards the second display area 128. In one embodiment, the gaming controller 16 may display an area 140 between the first display area 124 and the second display area 128 for displaying one or more symbols 82, or portions of symbols 82, between the first display area 124 and the second display area 128 as the reel 94 is spun. For example, the gaming controller 16 may spin the reel 94 to display a symbol 82 moving from the second display area 128, through the area 140, and through the first display area 124.

During game play, in the illustrated embodiment, the gaming controller 16 displays a primary game 142 including the first game 122 being displayed in the first display area 124 and the second game 126 being displayed in the second display area 128. The gaming controller 16 randomly generates an outcome of the first game 122, spins and stops the reels 94 to display the first game outcome 122 including a plurality of symbols 82 being displayed in the first display area 124, and provides an award to the player as a function of the first game outcome 122. The gaming controller 16 also determines an outcome of the second game 126 as a function of the symbols 82 being displayed in the second display area 128 and provides an additional award to the player as a function of the second game outcome 126. More specifically, the gaming controller 16 determines the first game outcome 122 as a function of the symbols 82 being displayed in the first portion 130 of the reel 94, and determines the second game outcome 126 as a function of the symbols 82 being displayed in the second portion 132 of the reel 94. In one embodiment, the gaming controller 16 may provide a first award to the player determined as a function of the first game outcome 122 and provide a second award determined as a function of the second game outcome 126. In another embodiment, the gaming controller 16 may provide the first award as a function of the first game outcome 122 and provide an enhanced award such as, for example, a first award multiplier as a function of the second game outcome 126.

In one embodiment, the gaming controller 16 may determine whether a triggering condition has occurred in the first game outcome 122, and determine the second game outcome 126 upon detecting the occurrence of the triggering condition in the first game outcome 122. In addition, the gaming controller 16 may also provide an award to the player as a function of the first game outcome 122, detect the appearance of the triggering condition in the first game outcome 122, and responsively provide an enhanced award to the player as a function of the second game outcome 126 upon detecting the triggering condition in the first game outcome 122. In one embodiment, the gaming controller 16 may provide an award if the first game outcome 122 and the second game outcome 126 each include a winning combination of symbols 82. In another embodiment, the gaming controller 16 may provide an award to the player if the first game outcome 122 and/or the second game outcome 126 include a winning combination. In the illustrated embodiment, the triggering condition may include the appearance of one or more special symbols in the game outcome. In another embodiment, the triggering condition may include a predefined combination of symbols being displayed in the game outcome, and/or any suitable triggering condition that enables the gaming machine 10 to function as described herein. In one embodiment, the gaming controller 16 may activate the first game 122 for play by the player with the second game 126 being inactive, and display the second game 126 only including the display of the reel 94, such that during play of the game, the player is awarded based on the outcome of the first game 122 and the second game 126 remains inactive such that the player is not awarded based on the outcome of the second game 126. Moreover, the gaming controller 16 may display the inactive second game 126 to indicate to the player that the second game 126 is inactive such as, for example displaying a notification symbol or displaying the second game 126 with a transparent and/or translucent display area 128 and/or symbols 82. In addition, upon detecting a triggering condition in the first game outcome 122, the gaming controller 16 may allow the player to play an additional game with the first and second games 122 and 126 being active, and provide an award to the player based on the outcomes of the first and second games 122 and 126.

In the illustrated embodiment, the gaming controller 16 allows a player to select a first payline 144 associated with a first set of cells 88 displayed in the first display area 124 and associated with the first game 122 prior to determining an outcome of the first game 122. The gaming controller 16 generates a second payline 146 associated with the second game 126 and displays the generated second payline 146 in the second display area 128 such that the second payline 146 is indicative of a second set of cells 88 that corresponds to the first set of cells 88. For example, in one embodiment, the player may select the first payline 144 associated with a 1$^{st}$ row 90 of cells 88 displayed in the first display area 124. In response to the player's selection, the gaming controller 16 generates and displays the second payline 146 along the 1$^{st}$ row 90 of cells 88 of the second display area 128. In addition, the gaming controller 16 may provide an award to the player as a function of the symbols 82 displayed along the first payline 144 in the first game 122 and the symbols 82 displayed along the second payline 146 in the second game 126. In another embodiment, the gaming controller 16 may allow a player to select each payline 96 associated with the first game 122 and the second game 126.

In one embodiment, the gaming controller 16 displays a primary game 142 that includes the first game 122 and the second game 126, and provides an award to the player as function of the first game outcome 122 and the second game outcome 126. In another embodiment, the gaming controller 16 may display the primary game 142 with the first game 122, as shown in FIG. 3, detect a trigging condition in the first game outcome 122, and provide the player a bonus game 148 that includes the first game 122 and the second game 126, as shown in FIG. 5.

In another embodiment, the gaming controller 16 may display a third game 150 in the game screen 56. More specifically, the gaming controller 16 displays the third game 150 including a third display area 152 and a third portion 154 of the reel 94 being displayed in the third display area 152. For example, the gaming controller 16 may display the third display area 152 along the longitudinal axis 136 and with respect to the first display area 124 and the second display area 128 such that the reel 94 extends through corresponding columns 92 of the first, second, and third display areas 124, 128, and 152 along the longitudinal axis 136. For example, as the reel 94 is rotated, a symbol 82 appearing the 1$^{st}$ column 92 associated with the third display area 152 is rotated through corresponding 1$^{st}$ columns 92 in the second display area 128 and the first display area 124.

In the illustrated embodiment, the gaming controller 16 displays the third game 150 concurrently with the first game 122 and the second game 126, and determines an outcome of the third game 150 as a function of the symbols 82 being displayed in the third portion 154 of the reel 94 in the third display area 152. The gaming controller 16 may also determine an award provided to the player as a function of the first game outcome 122, the second game outcome 126, and the third game outcome 150. In another embodiment, the gaming controller 16 determines the first game outcome 122 and the second game outcome 126, detects a triggering condition in the first game outcome 122 and/or the second game outcome 126, and responsively determines the third game outcome 150 as a function of the symbols 82 displayed in the third display area 152, and determines the award provided to the player as a function of the first game outcome 122, the second game outcome 126, and the third game outcome 150.

Figure 6:
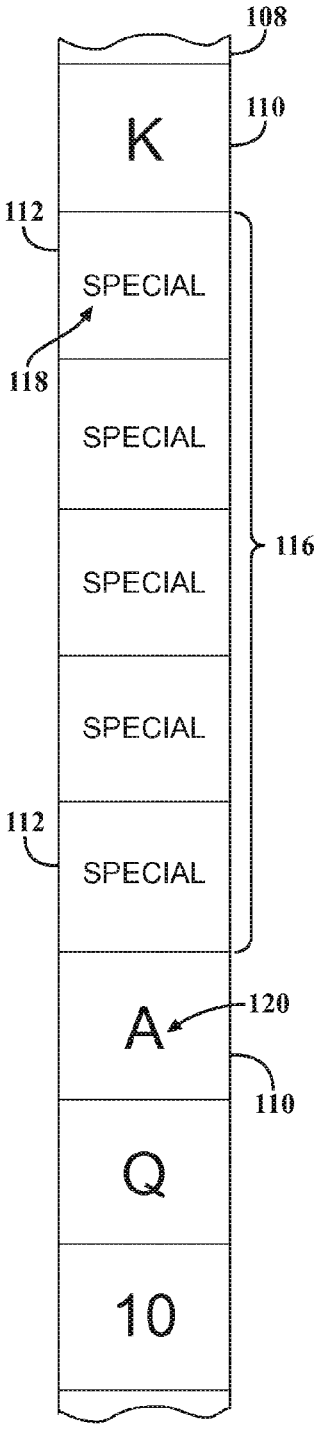
FIGS. 6-8 are schematic representations of a reel strip that may be used with at least one slot reel of the video slot game shown in FIGS. 3-5, according to an embodiment of the present invention.
Figure 7:
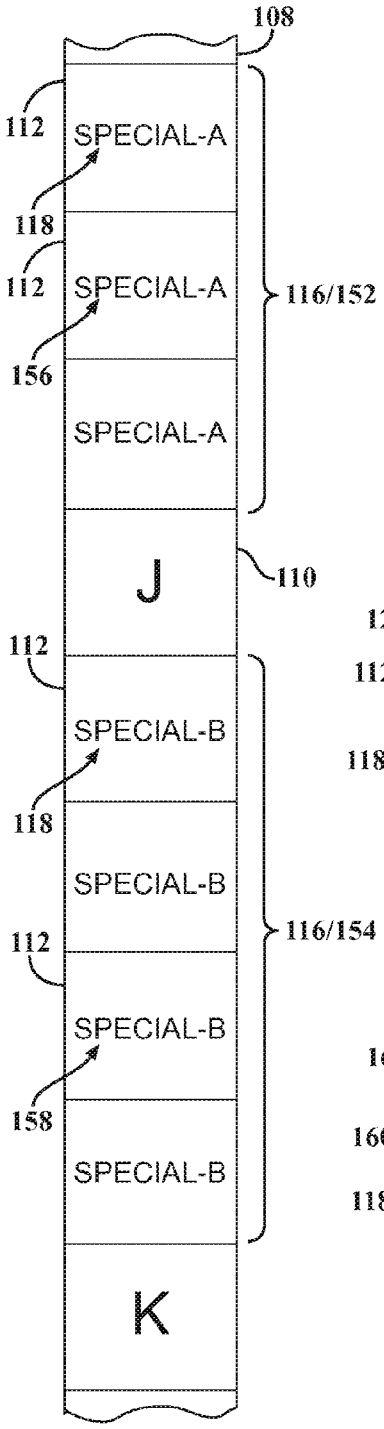
Figure 8:
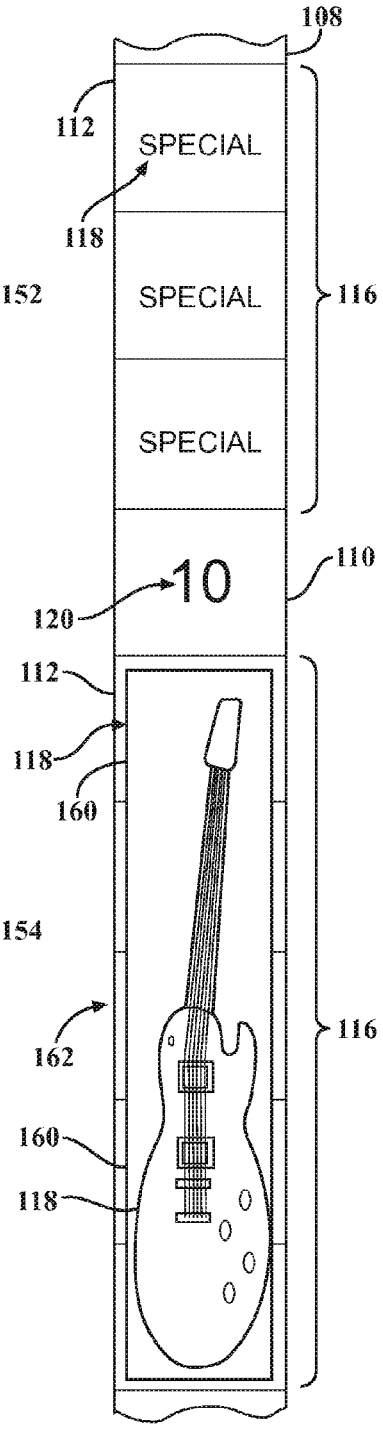

FIGS. 6-8 are schematic representations of a reel strip 108 that may be used with a slot reel 94. Referring to FIG. 6, in the illustrated embodiment, the reel strip 108 includes a plurality of special symbol positions 112, a plurality of normal symbol position 114, and at least one run 116 of consecutive special symbol positions 112 that include a plurality of adjacent special symbol positions 112. Each normal symbol position 114 includes a static normal symbol 120. During each play of the game 78, the gaming controller randomly selects at least one special symbol 118 from the predefined set of special symbols 118, and displays the selected special symbol 118 in each special symbol positions 112. Additional details of adjacent special symbol positions, which may be used in the present invention, are described in U.S. patent application Ser. No. 11/299,009 to Yoshimi, now U.S. Pat. No. 8,096,869, filed Dec. 9, 2005, titled "Gaming Machine with Runs of Consecutive Identical Symbols", which is incorporated herein by reference in its entirety.

Referring to FIG. 7, in one embodiment, the reel strip 108 may include a plurality of runs 116 of consecutive special symbol positions 112. For example, in one embodiment, the reel strip 108 may include at least two runs 116 of consecutive special symbol positions 112. During game play, the gaming controller 16 randomly selects a special symbol 118 and displays the selected special symbol 118 in each special symbol position 112 of the runs 116 of consecutive special symbol positions 112. Moreover, the reel strip 108 may include at least one normal symbol position 114 displayed between the runs 116 of consecutive special symbol positions 112.

In one embodiment, the gaming controller 16 may randomly select a different special symbol 118 to be displayed in each of the runs 116 of consecutive special symbol positions 112 and display a corresponding selected special symbol 118 in each special symbol position 112 of the associated run 116 of consecutive special symbol positions 112. For example, in one embodiment, the gaming controller 16 may select a first special symbol 156 (e.g. "Special-A") to be displayed in a first run 152 of consecutive special symbol positions 112, and select a second special symbol 158 (e.g. "Special-B") to be displayed in a second run 154 of consecutive special symbol positions 112. In one embodiment, the first special symbol 156 and the second special symbol 158 are different. In another embodiment, the first special symbol 156 and the second special symbol 158 are similar. Moreover, the first and second special symbols 156 and 158 may be the same special symbol. In addition, the first and second special symbols 156 and 158 may be selected from the same category of special symbols and/or be selected from different categories of special symbols.

Referring to FIG. 8, in one embodiment, the gaming controller 16 may display a special symbol 118 having a plurality of symbol images 160 such that a plurality of adjacent special symbols 118 are displayed as a unitary image 162 that extends across a run 116 of consecutive special symbol positions 112. For example, the gaming controller 16 may randomly select a special symbol 118 to be displayed in each special symbol position 112 of a run 116 of consecutive special symbol positions 112, wherein the selected special symbol 118 includes a plurality of symbol images 160. Each selected special symbol 118 is displayed in each of the adjacent special symbol positions 112 with a different symbol image 160 such that a unitary symbol image 162 extends across each adjacent special symbol position 112.

In another embodiment, the gaming controller 16 may select a plurality of special symbols 118 from the same category of special symbols, wherein each selected special symbol 118 forms a portion of the unitary symbol image 162 such that when the selected special symbols 118 are displayed in each adjacent special symbol position 112 of a run 116 of consecutive special symbol positions 112, the unitary symbol image 162 is displayed across the adjacent special symbol positions 112.

Figure 9:
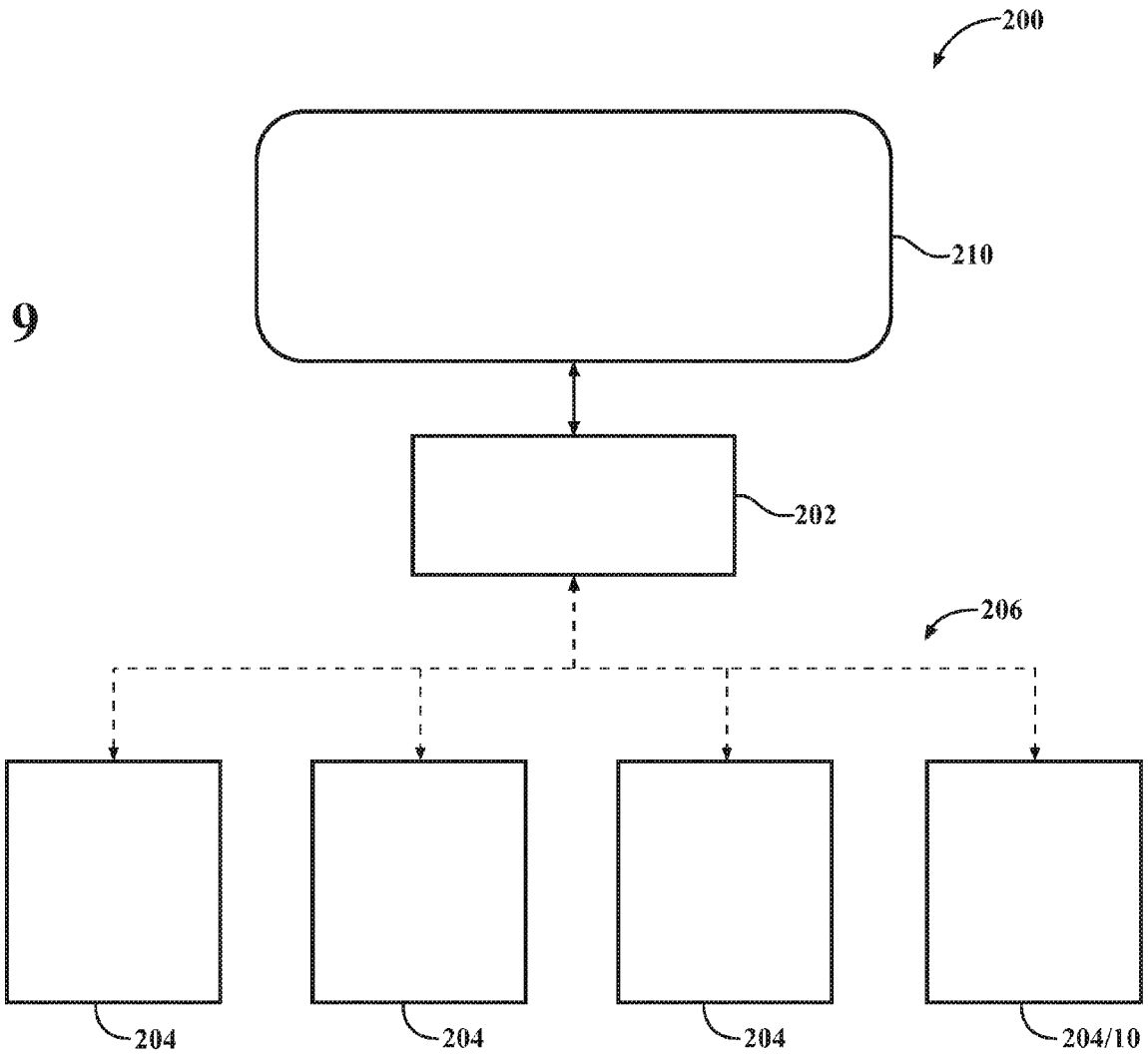
FIG. 9 is a schematic view of an exemplary gaming system of the present invention.

FIG. 9 is a schematic view of an exemplary gaming system 200. The gaming system 200 includes a system controller 202 and one or more gaming devices 204 that are coupled to the system controller 202. In one embodiment, the gaming device 204 includes the gaming machine 10. In another embodiment, gaming device 204 may include a personal computer, laptop, cell phone, smartphone, tablet computer, personal data assistant, and/or any suitable computing device that enables a player to connect to system controller 202 to play the game 78.

In the illustrated embodiment, the system controller 202 is configured to perform all of the functions of the gaming controller 16 as described herein. The system controller 202 communicates with each gaming device 204 for playing the game 78 on each gaming device 204 based on user selection input received from each gaming device 204. In the illustrated embodiment, the system controller 202 plays a separate instance of the game 78 on each gaming device 204 such that each player associated with the gaming devices 204 may play a separate instance of the game 78 simultaneously.

Referring to FIG. 5, in the illustrated embodiment, the system controller 202 displays the game 78 on at least one of the gaming devices 204. Moreover, the system controller 202 displays the game 78 including a plurality of game outcomes 80 being displayed using the same reel 94. In the illustrated embodiment, the system controller 202 displays the game 78 including a first game 122 being displayed in a first display area 124 and a second game 126 being displayed in a second display area 128 that is different than the first display area 124. The first game 122 and the second game 126 are each displayed in the same game screen 56. The system controller 202 displays the first game 122 and the second game 126 with at least one reel 94 that extends from the first game 122 to the second game 126 such that a portion of the reel 94 is displayed in the first display area 124 and the second display area 128 simultaneously. For example, in the illustrated embodiment, the system controller 202 displays the first game 122 with a first portion 130 of the reel 94 being displayed in the first display area 124, and displays the second game 126 with a second portion 132 of the reel 94 being displayed in the second display area 128. The system controller 202 displays the first game 122 concurrently with the second game 126 such that the first and second portions 130 and 132 of the reel 94 are visible to the player simultaneously.

In the illustrated embodiment, the gaming devices 204 and the system controller 202 are coupled in communication with a local area network (LAN) 206. Alternatively, the gaming devices 204 and the system controller 202 may be coupled via a network such as, for example, an Internet link, an intranet, a WAN, dial-in-connections, cable modems, wireless modems, and/or ISDN lines. In the illustrated embodiment, the gaming system 200 includes four gaming machines 10, which in one embodiment as shown in FIG. 9 are arranged in a bank 208, i.e., are arranged together, adjacently. It should be noted, however, that the gaming system 200 may include any number of gaming machines 10 that may be arranged in any manner, such as in a circle or along a curved arc, or positioned within separate areas of a casino floor, and/or separate gaming establishments such as different casinos. Furthermore, additional groups of gaming machines 10 may be coupled to the system controller 202. In addition, in the illustrated embodiment, the gaming system 200 may also include a central display 210 that is coupled to the system controller 202 for displaying games played on one or more of the gaming machines 10.

In one embodiment, the system controller 202 may be implemented by one of the gaming controllers 16 associated with a gaming machine 10. In still another embodiment, the system controller 202 may be located remotely with respect to gaming machines 10, or within one of the gaming machine cabinet assemblies 18 (shown in FIG. 1).

In one embodiment, the system controller 202 may also determine if a bonus triggering event occurs in a game outcome being played at one or more of the gaming machines 10, and displays a bonus game such as, for example, the game 78 on the central display 210 if the bonus triggering event occurs. Alternatively, the system controller 202 may display the game 78 at one or more gaming machines 10 based on one or more bonus triggering events occurring in games played at the gaming machines 10. The bonus triggering event may be the appearance of a predefined symbol and/or a predefined symbol combination in a game outcome.

Figure 10:
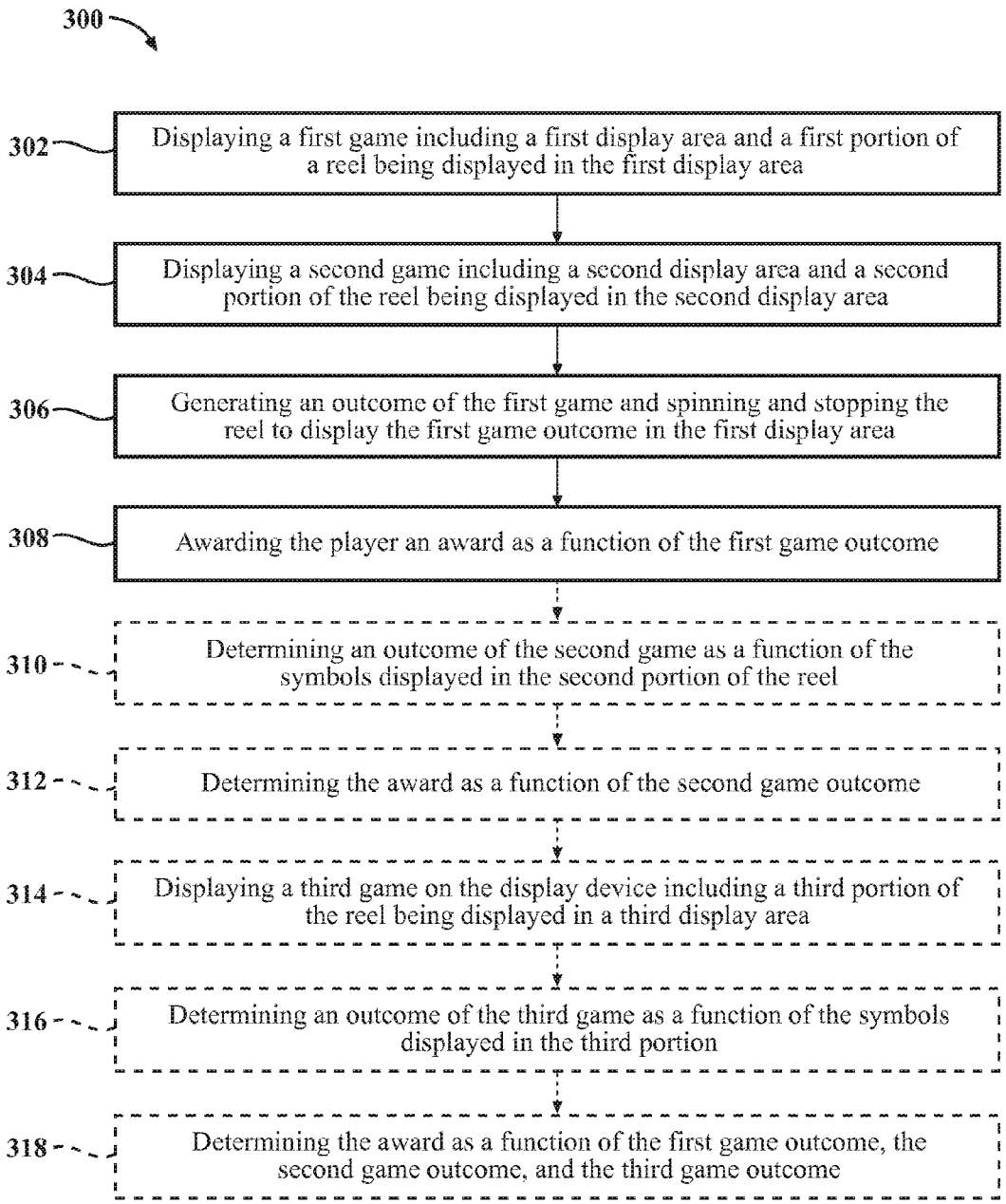
FIG. 10 is a flowchart of an exemplary method of allowing a player to play a gaming machine, according to an embodiment of the present invention.

FIG. 10 is a flowchart of an exemplary method 300 of allowing a player to play a slot game with the gaming machine 10. Each method step may be performed independently of, or in combination with, other method steps. Portions of the method 300 may be performed by any one of, or any combination of, the components of the system 200 and/or gaming machine 10. In the illustrated embodiment, the method 300 includes displaying 302 a first game including a first display area and a first portion of a reel being displayed in the first display area, displaying 304 a second game including a second display area and a second portion of the reel being displayed in the second display area, generating 306 an outcome of the first game and spinning and stopping the reel to display the first game outcome in the first display area, and awarding 308 the player an award as a function of the first game outcome.

In one embodiment, the method 300 also includes determining 310 an outcome of the second game as a function of the symbols displayed in the second portion of the reel, and determining 312 the award as a function of the second game outcome. The method 300 may also include displaying 314 a third game on the display device including a third portion of the reel being displayed in a third display area, determining 316 an outcome of the third game as a function of the symbols displayed in the third portion, and determining 318 the award as a function of the first game outcome, the second game outcome, and the third game outcome.

The method 300 may also include detecting a triggering condition in one of the first game outcome and the second game outcome and responsively determining an outcome of the third game as a function of the symbols displayed in the third portion of the at least one reel in the third display area and determining the award as a function of the first game outcome, the second game outcome, and the third game outcome. In addition, the method 300 may include detecting a triggering condition in the first game outcome and responsively determining an outcome of the second game as a function of the symbols displayed in the second portion of the at least one reel in the second display area and determining the award as a function of the second game outcome. The method 300 may also include allowing a player to select a first payline associated with the first game and generating a second payline associated with the second game and corresponding to the first payline.

The above-described system, apparatus, and methods overcome at least some disadvantages of known gaming machines by providing a gaming machine that simultaneously displays a plurality of slot games using the same reel. More specifically, the gaming machine allows a player to play multiple games with the same reel by displaying a portion of the same reel in each slot game. By providing a gaming machine that concurrently displays a plurality of slot games with the same reel, the player can anticipate a potential combination of symbols appearing in the first game as the symbols are moved from the second game display area towards the first game display area. Thus, the amount of time that the game is played by patrons of a gaming establishment is thereby increased.

Exemplary embodiments of a gaming machine, a gaming system, and a method of allowing a player to play a gaming machine are described above in detail. The gaming machine, system, and method are not limited to the specific embodiments described herein, but rather, components of the gaming machine and/or system and/or steps of the method may be utilized independently and separately from other components and/or steps described herein. For example, the gaming machine may also be used in combination with other gaming systems and methods, and is not limited to practice with only the gaming machine as described herein. Rather, an exemplary embodiment can be implemented and utilized in connection with many other gaming system applications.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A method of allowing a player to play a slot game with a gaming machine, the slot game including a plurality of reels, each reel having a plurality of game symbols in a predetermined order, the method comprising the steps of:

displaying, on a display device, a plurality of games, each of the plurality of games being displayed in a corresponding display area;

displaying at least one reel of the plurality of reels extending across each of the display areas;

displaying a first game in a first display area and including a first portion of the at least one reel being displayed in the first display area;

displaying a second game in a second display area and including a second portion of the at least one reel being displayed in the second display area, the second game being displayed concurrently with the first game, the second display area being positioned with respect to the first display area to define an area between the first and the second display areas;

randomly generating an outcome of the first game and spinning and stopping the at least one reel to display the first game outcome in the first display area, the at least one reel being displayed with a plurality of game symbols being visible within the defined area between the first and the second display areas; and, awarding the player an award as a function of the first game outcome.

2. A gaming machine, comprising:

a display device for displaying a plurality of slot games, each of the plurality of slot games including a plurality of reels, each reel having a plurality of game symbols in a predetermined order, each of the plurality of slot games being displayed in a corresponding display area;

a user input device configured to generate a signal indicative of a player's selection input; and a controller coupled to the display device and the user input device, the controller for displaying at least one reel of the plurality of reels extending across each of the display areas, displaying a first game in a first display area and including a first portion of the at least one reel being displayed in the first display area, and displaying a second game in a second display area and including a second portion of the at least one reel being displayed in the second display area, the second game being displayed concurrently with the first game, the second display area being positioned with respect to the first display area to define an area between the first and the second display areas, the controller for randomly generating an outcome of the first game and spinning and stopping the at least one reel to display the first game outcome in the first display area and awarding the player an award as a function of the first game outcome, the at least one reel being displayed with a plurality of game symbols being visible within the defined area between the first and the second display areas.

3. The method of claim 1 and the gaming machine of claim 2, wherein the at least one reel extends along a longitudinal axis, the second display area is spaced a distance from the first display area along the longitudinal axis.

4. The method of claim 1 and the gaming machine of claim 2, wherein the second display area is orientated with respect to the first display area such that a symbol displayed in the at least one reel is moved from the second display area to the first display area as the at least one reel is spun.

5. The method of claim 1 and the gaming machine of claim 2, the controller:

determining an outcome of the second game as a function of the symbols displayed in the second portion of the at least one reel in the second display area; and determining the award as a function of the second game outcome.

6. The method and the gaming machine of claim 5, the controller displaying a third game on the display device, the third game including a third portion of the at least one reel being displayed in a third display area, the third game being displayed concurrently with the first and second games.

7. The method and the gaming machine of claim 6, the controller:

determining an outcome of the third game as a function of the symbols displayed in the third portion of the at least one reel in the third display area; and determining the award as a function of the first game outcome, the second game outcome, and the third game outcome.

8. The method and the gaming machine of claim 6, the controller:

detecting a triggering condition in one of the first game outcome and the second game outcome; and responsively determining an outcome of the third game as a function of the symbols displayed in the third portion of the at least one reel in the third display area and determining the award as a function of the first game outcome, the second game outcome, and the third game outcome.

9. The method of claim 1 and the gaming machine of claim 2, the controller:

detecting a triggering condition in the first game outcome; and responsively determining an outcome of the second game as a function of the symbols displayed in the second portion of the at least one reel in the second display area and determining the award as a function of the second game outcome.

10. The method of claim 1 and the gaming machine of claim 2, wherein each of the first display area and the second display area includes a grid having a plurality of cells, each of the cells having a corresponding symbol displayed therein, the controller:

allowing a player to select a first payline associated with the first game, the first payline indicative of a first set of cells displayed in the first display area; and generating a second payline associated with the second game, the second payline indicative of a second set of cells displayed in the second display area, the second set of cells corresponding to the first set of cells.

11. The method and the gaming machine of claim 10, the controller determining the award as a function of the symbols displayed in the first set of cells in the first game and the second set of cells in the second game.

12. A system, comprising:

a plurality of gaming devices, each gaming device including a user input device for accepting a player's selection input and a display device; and a system controller coupled to each gaming device of the plurality of gaming devices for displaying a plurality of slot games on at least one gaming device, each of the plurality of slot games including a plurality of reels, each reel having a plurality of game symbols in a predetermined order, each of the plurality of slot games being displayed in a corresponding display area, the system controller for displaying at least one reel of the plurality of reels extending across each of the display areas, displaying a first game in a first display area and including a first portion of the at least one reel being displayed in the first display area, and displaying a second game in a second display area and including a second portion of the at least one reel being displayed in the second display area, the second game being displayed concurrently with the first game, the second display area being positioned with respect to the first display area to define an area between the first and the second display areas, the system controller for randomly generating an outcome of the first game and spinning and stopping the at least one reel to display the first game outcome in the first display area and awarding the player an award as a function of the first game outcome, the at least one reel being displayed with a plurality of game symbols being visible within the defined area between the first and the second display areas.

13. A system in accordance with claim 12, wherein the second display area is orientated with respect to the first display area such that a symbol displayed in the at least one reel is moved from the second display area to the first display area as the at least one reel is spun.

14. A system in accordance with claim 12, the system controller for determining an outcome of the second game as a function of the symbols displayed in the second portion of the at least one reel in the second display area and determining the award as a function of the second game outcome.

15. A system in accordance with claim 14, the system controller for displaying a third game on the display device, the third game including a third portion of the at least one reel being displayed in a third display area, the third game being displayed concurrently with the first and second games.

16. A system in accordance with claim 15, the system controller for determining an outcome of the third game as a function of the symbols displayed in the third portion of the at least one reel in the third display area and determining the award as a function of the first game outcome, the second game outcome, and the third game outcome.

17. A system in accordance with claim 15, the system controller for detecting a triggering condition in one of the first game outcome and the second game outcome and responsively determining an outcome of the third game as a function of the symbols displayed in the third portion of the at least one reel in the third display area and determining the award as a function of the first game outcome, the second game outcome, and the third game outcome.

18. A system in accordance with claim 12, the system controller for detecting a triggering condition in the first game outcome and responsively determining an outcome of the second game as a function of the symbols displayed in the second portion of the at least one reel in the second display area and determining the award as a function of the second game outcome.

19. A system in accordance with claim 12, wherein each of the first display area and the second display area includes a grid having a plurality of cells, each of the cells having a corresponding symbol displayed therein, the system controller for allowing a player to select a first payline associated with the first game, the first payline indicative of a first set of cells in the first display area and generating a second payline associated with the second game, the second payline indicative of a second set of cells in the second display area, the second set of cells corresponding to the first set of cells.

20. One or more non-transitory computer-readable storage media, having computer-executable instructions embodied thereon, wherein when executed by at least one processor, the computer-executable instructions cause the processor to:

display a plurality of games on a display device, each of the plurality of games including a plurality of reels, each reel having a plurality of game symbols in a predetermined order, each of the plurality of games being displayed in a corresponding display area;

display at least one reel of the plurality of reels extending across each of the display areas;

display a first game in a first display area and including a first portion of the at least one reel being displayed in the first display area;

display a second game in a second display area and including a second portion of the at least one reel being displayed in the second display area, the second game being displayed concurrently with the first game, the second display area being positioned with respect to the first display area to define an area between the first and the second display areas;

randomly generate an outcome of the first game and spin and stop the at least one reel to display the first game outcome in the first display area, the at least one reel being displayed with a plurality of game symbols being visible within the defined area between the first and the second display areas; and, award the player an award as a function of the first game outcome.

* * * * *